US007522128B2

(12) United States Patent
Tokunaga et al.

(10) Patent No.: US 7,522,128 B2
(45) Date of Patent: Apr. 21, 2009

(54) PLASMA DISPLAY DEVICE

(75) Inventors: Tsutomu Tokunaga, Yamanashi-ken (JP); Masaru Nishimura, Yamanashi-ken (JP); Kazuaki Sakata, Yamanashi-ken (JP); Atsushi Hirota, Yamanashi-ken (JP); Hai Lin, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 736 days.

(21) Appl. No.: 11/135,669

(22) Filed: May 24, 2005

(65) Prior Publication Data

US 2005/0264487 A1 Dec. 1, 2005

(30) Foreign Application Priority Data

May 25, 2004 (JP) ..... 2004-154397
Jul. 12, 2004 (JP) ..... 2004-204156
Oct. 1, 2004 (JP) ..... 2004-289791

(51) Int. Cl.
*G09G 3/28* (2006.01)

(52) U.S. Cl. ..... 345/60; 345/66

(58) Field of Classification Search ..... 345/60–68, 345/37, 204; 313/581–587, 484, 485, 486; 315/169.1, 169.4
See application file for complete search history.

(56) References Cited

U.S. PATENT DOCUMENTS 6,486,611 B2 11/2002 Tokunaga et al.
6,624,588 B2 * 9/2003 Nakamura ..... 315/169.1
7,333,076 B2 10/2008 Tokunaga et al.
2001/0050534 A1 12/2001 Amemiya et al.
2002/0130825 A1 9/2002 Kang
2003/0001801 A1 1/2003 Setoguchi et al.
2003/0034937 A1 * 2/2003 Kim ..... 345/63
2003/0132897 A1 7/2003 Tokunaga
2003/0137471 A1 * 7/2003 Iwami ..... 345/60
2004/0051689 A1 3/2004 Nakamura et al.
2004/0075388 A1 4/2004 Miyashita et al.
2006/0050022 A1 * 3/2006 Kang ..... 345/60

FOREIGN PATENT DOCUMENTS

CN 1327253 A 12/2001
CN 1405829 A 3/2003
EP 1 298 694 A1 4/2003

(Continued)

OTHER PUBLICATIONS

Taiwanese Search Report dated Oct. 5, 2007, with partial English translation.

(Continued)

*Primary Examiner*—Nitin Patel
(74) *Attorney, Agent, or Firm*—McGinn IP Law Group, PLLC

(57) ABSTRACT

A plasma display device having a plasma display panel in which, each display cell contains a magnesium oxide layer including magnesium oxide crystals that are excited by an electron beam to emit cathode luminescence light having a peak in a wavelength range of 200 to 300 nm. In an addressing period, a row electrode driving circuit applies a scanning pulse to one row electrodes of row electrode pairs in turn, while a column electrode driving circuit supplies column electrodes with data pulses corresponding to one row electrode which is applied with the scanning pulse.

12 Claims, 13 Drawing Sheets

FOREIGN PATENT DOCUMENTS

| | | | |
|---|---|---|---|
| EP | 1 335 342 | A2 | 8/2003 |
| EP | 1 365 381 | | 11/2003 |
| EP | 1 381 016 | | 1/2004 |
| EP | 1 591 988 | A2 | 11/2005 |
| EP | 1 594 115 | A2 | 11/2005 |
| EP | 1 600 919 | A2 | 11/2005 |
| JP | 07-192630 | | 7/1995 |
| JP | 7-192630 | | 7/1995 |
| JP | 8-300701 | | 11/1996 |
| JP | 2000-306550 | | 11/2000 |

OTHER PUBLICATIONS

European Search Report dated, Oct. 31, 2007.

Chinese Office Action dated Aug. 24, 2007, with English translation.

Saksena, B.D., et al. "Cathodo-Luminescence of MgO", National Physical Laboratory of India, New Delhi, India, Jun. 8, 1954, pp. 814-815.

* cited by examiner

CROSS - SECTION ALONG V3 - V3

CROSS - SECTION ALONG W2 - W2

PLASMA DISPLAY DEVICE

BACKGROUND OF THE INVENTION

1. Field of the Invention

The present invention relates to a plasma display device in which a plasma display panel is used.

2. Description of the Related Art

For driving a plasma display panel (PDP), a one-field display period is composed of a plurality of sub-fields, each including an addressing period and a sustain period, to display images at multiple gradation levels. In a gradation display method, when the number of display lines is increased for a higher definition or when the number of sub-fields is increased for an increased number of gradation levels, the proportion of the addressing period relatively increases in the one-field display period. If the pulse width of a scanning pulse is simply narrowed down to limit the increased addressing period, a selective discharge becomes uncertain due to a delayed discharge and the like. To solve this problem, a driving method, which divides column electrodes of a PDP into two groups, i.e., an upper and a lower region of the panel and permits simultaneous address scanning in the upper and lower regions of the panel to reduce the addressing period to one half, is employed. The field is used herein in consideration of an interlace video signal such as a video signal of the NTSC standard, and corresponds to a frame in a non-interlace video signal.

FIG. 1 generally shows a configuration of a plasma display device to which the conventional driving method is applied. The plasma display device comprises a PDP 100, a driving control circuit 101, an X-row electrode driving circuit 102, a Y-row electrode driving circuit 103, an upper column electrode driving circuit 104, and a lower column electrode driving circuit 105. The PDP 100 comprises column electrodes $Du_1$-$Du_m$ and column electrodes $Dd_1$-$Dd_m$ as address electrodes, and row electrodes $X_1$-$X_n$ and row electrodes $Y_1$-$Y_n$ which are arranged to intersect with these column electrodes. The column electrodes $Du_1$-$Du_m$ are column electrodes in an upper region of the panel, and intersect with row electrodes $X_1$-$X_{n/2}$ and row electrodes $Y_1$-$Y_{n/2}$. The column electrodes $Dd_1$-$Dd_m$ are column electrodes in a lower region of the panel, and intersect with row electrodes $X_{n/2+1}$-$X_n$ and row electrodes $Y_{n/2+1}$-$Y_n$. Row electrode pairs $(X_1, Y_1)$, $(X_2, Y_2)$, $(X_3, Y_3)$, . . . , $(X_n, Y_n)$ serve as a first display line to an n-th display line on the PDP 100, respectively. At an intersection of each of the display lines and each of the column electrodes $Du_1$-$Du_m$ and column electrode $Dd_1$-$Dd_m$, a display cell CS is formed to serve as a pixel.

The driving control circuit 101 generates control signals to the respective X-row electrode driving circuit 102, Y-row electrode driving circuit 103, upper column electrode driving circuit 104, and lower column electrode driving circuit 105 in response to an input video signal in accordance with the sub-field method mentioned above.

FIG. 2 shows a light emission driving sequence in accordance with the sub-field method. In this light emission driving sequence, in a display period for each field (frame) of an input video signal, i.e., in a unit display period which is spent for displaying one screen of image, N sub-fields SF1-SFN are executed. Each of the sub-fields SF1-SFN includes an addressing stage W, a sustain stage I, and an erasure stage E. Only the first sub-field SF1 includes a reset stage R. These sub-fields SF1-SFN are weighted for the luminance in an ascending order in each field. Specifically, the first sub-field SF1 has the smallest luminance weighting coefficient, and the last sub-field SFN has the largest luminance weighting coefficient. A scanning pulse in the addressing stage W is first applied to the row electrode $Y_1$ in the upper region of the panel, and sequentially applied to the row electrodes $Y_2$, $Y_3$, . . . , $Y_{n/2}$ in that order. Simultaneously with the application, the scanning pulse is applied to the row electrode $Y_n$ in the lower region of the panel, and sequentially applied to the row electrodes $Y_{n-1}$, $Y_{n-2}$, . . . , $Y_{n/2+1}$ in that order.

The X-row electrode driving circuit 102 applies a variety of driving pulses to each of the row electrodes $X_1$-$X_n$ of the PDP 100 in response to a control signal supplied from the driving control circuit 101. The Y-row electrode driving circuit 103 applies a variety of driving pulses to each of the row electrodes $Y_1$-$Y_n$ of the PDP 100 in response to a control signal supplied from the driving control circuit 101. The upper column electrode driving circuit 104 applies a pixel data pulse to the column electrodes $Du_1$-$Du_m$ of the PDP 100 in response to a control signal supplied from the driving control circuit 101. The lower column electrode driving circuit 105 applies a pixel data pulse to the column electrode $Dd_1$-$Dd_m$ of the PDP 100 in response to a control signal supplied from the driving control circuit 101.

FIG. 3 is a diagram showing timings at which a variety of driving pulses are applied to the column electrodes D, row-electrodes $X_1$-$X_n$ and Y in the sub-field SF1 extracted from the sub-fields SF1-SFN.

First, in a reset stage R executed only in the first sub-field SF1, the X-row electrode driving circuit 102 simultaneously applies a reset pulse $RP_X$ of negative polarity, as shown in FIG. 3, to the row electrodes $X_1$-$X_n$. Further, simultaneously with the application of the reset pulse $RP_X$, the Y-row electrode driving circuit 103 simultaneously applies the row electrodes $Y_1$-$Y_n$ with a first reset pulse $RP_{Y1}$ of positive polarity which has the pulse waveform, the voltage value of which slowly increases over time to reach a peak voltage value, as shown in FIG. 3. With the simultaneous application of the reset pulse $RP_{Y1}$ and reset pulse $RP_X$ of negative polarity, a first reset discharge is produced between the X-row electrode and Y-row electrode in each of all the display cells. After the end of the first reset discharge, a predetermined amount of wall charge is formed in a discharge space of each display cell. Subsequently, the Y-row electrode driving circuit 103 generates a second reset pulse $RP_{Y2}$ of negative polarity which changes slow in voltage at a falling edge, and simultaneously applies the second reset pulse $RP_{Y2}$ to all the row electrodes $Y_1$-$Y_n$. In response to the application of the second reset pulse $RP_{Y2}$, a second reset discharge is produced between the X-row electrode and the Y-row electrode in each of all the display cells. The second reset discharge extinguishes the wall charge formed in each of all the display cells.

Next, in the addressing stage W of each sub-field, each of the upper column electrode driving circuit 104 and lower column electrode driving circuit 105 generates a pixel data pulse for setting whether or not each discharge cell should be driven to emit light in the sub-field based on an input video signal. The upper column electrode driving circuit 104 sequentially applies the pixel data pulse for one display line (m) to the column electrodes $Du_1$-$Du_m$ as a group of pixel data pulses $DP_1$, $DP_2$, . . . , $DP_{n/2}$. The lower column electrode driving circuit 105 sequentially applies th pixel data pulse for one display line to the column electrodes $Dd_1$-$Dd_m$ as a group of pixel data pulses $DP_n$, $DP_{n-1}$, . . . , $DP_{n/2+1}$. In the meantime, the Y-row electrode driving circuit 103 sequentially applies a scanning pulse of negative polarity to the row electrodes $Y_1$-$Y_{n/2}$ in synchronism with the timing of each of the pixel data pulses $DP_1$-$DP_{n/2}$, and sequentially applies the scanning pulse SP of negative polarity to the row electrodes $Y_1$-$Y_{n/2+1}$ in synchronism with the timing of each of the pixel data pulses $DP_n$-$DP_{n/2+1}$. In this event, a discharge (selective discharge) is produced only in those display cells which are applied with the scanning pulse SP and is also applied with the pixel data pulse at high voltage, resulting in the formation of a predetermined amount of wall charge in the discharge space of each of these display cells. With the execution of the addressing stage W, each discharge cell is set to one of a lit cell state in which a predetermined amount of wall charge exists, and an unlit cell state in which no wall charge exists.

Next, in the sustain stage I of each sub-field, each of the X-row electrode driving circuit 102 and Y-row electrode driving circuit 103 applies sustain pulses $IP_X$, $IP_Y$ of positive polarity to the row electrodes $X_1$-$X_n$, $Y_1$-$Y_n$ a number of times (for a duration) corresponding to the luminance weighting of the sub-field. In the sustain stage I of each of the sub-fields SF1-SF(N), only those discharge cells which are in the lit cell state as mentioned above discharge for sustaining the light each time they are applied with the sustain pulse $IP_X$ or $IP_Y$.

Then, in the erasure stage E of each sub-field, the Y-row electrode driving circuit 103 sequentially applies the row electrodes $Y_1$-$Y_n$ with an erasure pulse EP of negative polarity as shown in FIG. 3. In response to the application of the erasure pulse EP, an erasure discharge is produced in those discharge cells which have produced the sustain discharge in the preceding sustain stage I. The erasure discharge extinguishes the wall charges formed in the display cells, causing the discharge cells to transition to the unlit cell state.

However, in the conventional plasma display device, the address scanning is sequentially performed toward a display line which adjoins a boundary from which the column electrodes are divided from a display line at the upper end and a display line at the lower end of the panel. This address scanning technique requires a column electrode driving circuit for each of the column electrode groups which are divided into an upper and a lower section, resulting in a higher cost. Also, a problem still remains unchanged in regard to the stability of the address discharge because the address discharge is more difficult to occur in display lines which are scanned in later turns, as compared with the display line which is scanned first.

SUMMARY OF THE INVENTION

It is an object of the present invention to provide a plasma display device and a driving method therefor which are capable of speeding up address scanning without damaging the stability of the address scanning.

A plasma display device according to the present invention comprises a plasma display panel including a plurality of row electrode pairs which constitute display lines, a plurality of column electrodes intersecting with the plurality of row electrode pairs, and display cells each formed at each of the intersections of the row electrode pairs with the column electrodes, each of the display cells having a magnesium oxide layer including magnesium oxide crystals which are excited by an electron beam to emit cathode luminescence light having a peak in a wavelength range from 200 to 300 nm; a row electrode driving circuit for driving each of the plurality of row electrode pairs; and a column electrode driving circuit for driving each of the plurality of column electrodes, so that a halftone image is displayed in a one-field display period which is divided into a plurality of sub-fields each of which includes an addressing period and a sustain period, wherein in the addressing period, the row electrode driving circuit applies a scanning pulse to one row electrodes of the row electrode pairs in turn, while the column electrode driving circuit supplies the column electrodes with data pulses corresponding to a display line which are applied with the scanning pulse.

A method for driving a plasma display panel according to the present invention is provided for driving a plasma display panel which includes a plurality of row electrode pairs which constitute display lines, a plurality of column electrodes intersecting with the plurality of row electrodes, and display cells each formed at each of the intersections of the row electrode pairs with the column electrodes, each of the display cells having a magnesium oxide layer including magnesium oxide crystals which are excited by an electron beam to emit cathode luminescence light having a peak in a wavelength range from 200 to 300 nm, to display a halftone image in a one-field display period which is divided into a plurality of sub-fields each of which includes an addressing period and a sustain period, the method comprising the step of: in the addressing period, applying a scanning pulse to one row electrodes of the row electrode pairs in turn, and supplying the column electrodes with data pulses corresponding to display lines which are applied with the scanning pulse.

DETAILED DESCRIPTION OF THE INVENTION

In the following, embodiments of the present invention will be described in detail with reference to the drawings.

Figure 1:
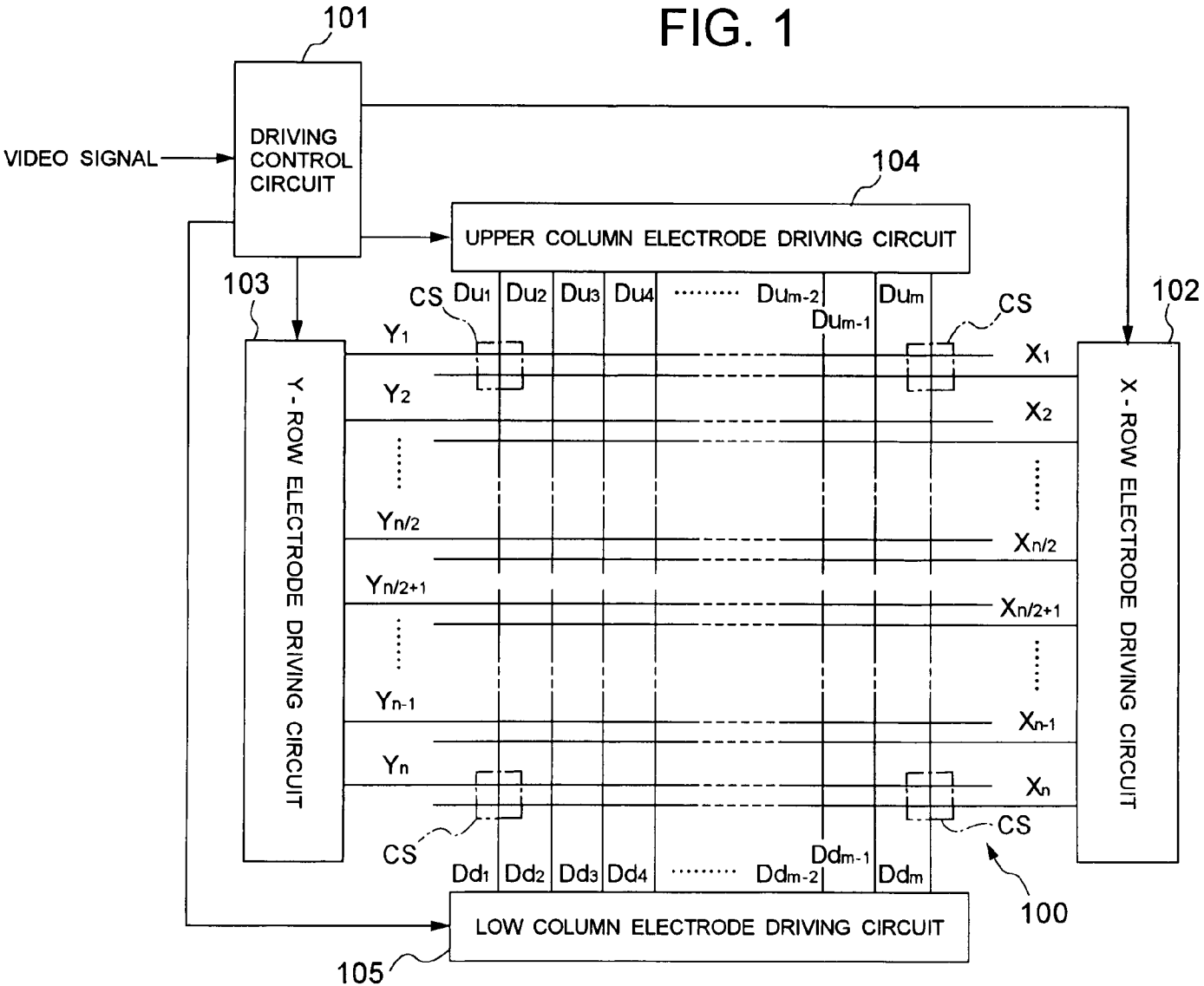
FIG. 1 is a diagram generally showing the configuration of a conventional plasma display device.
Figure 2:
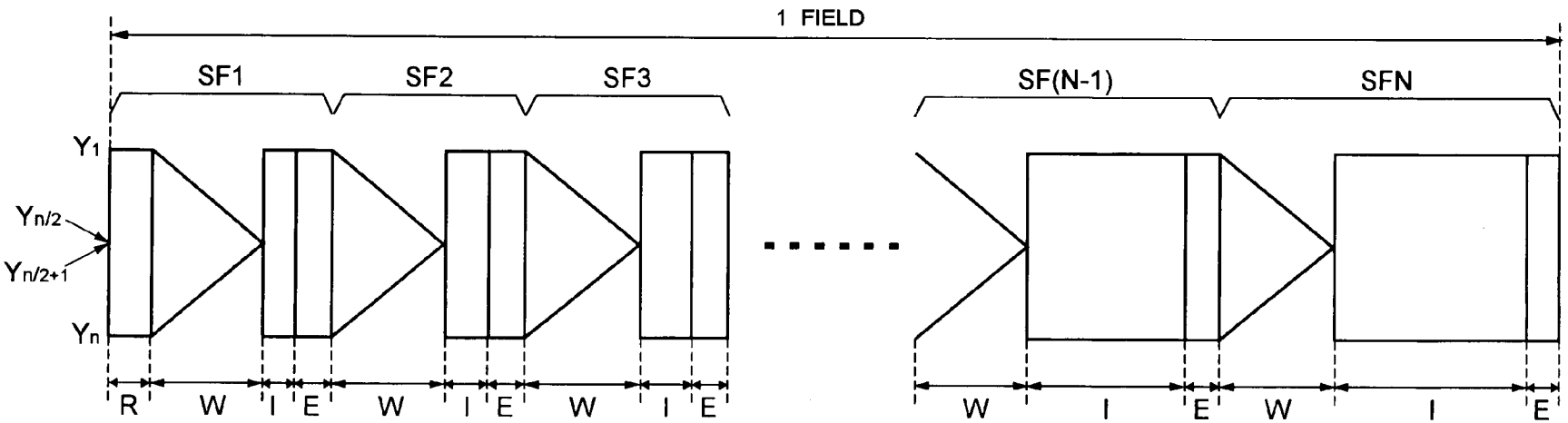
FIG. 2 is a diagram showing an exemplary light emission driving sequence which is employed in the plasma display device shown in FIG. 1.
Figure 3:
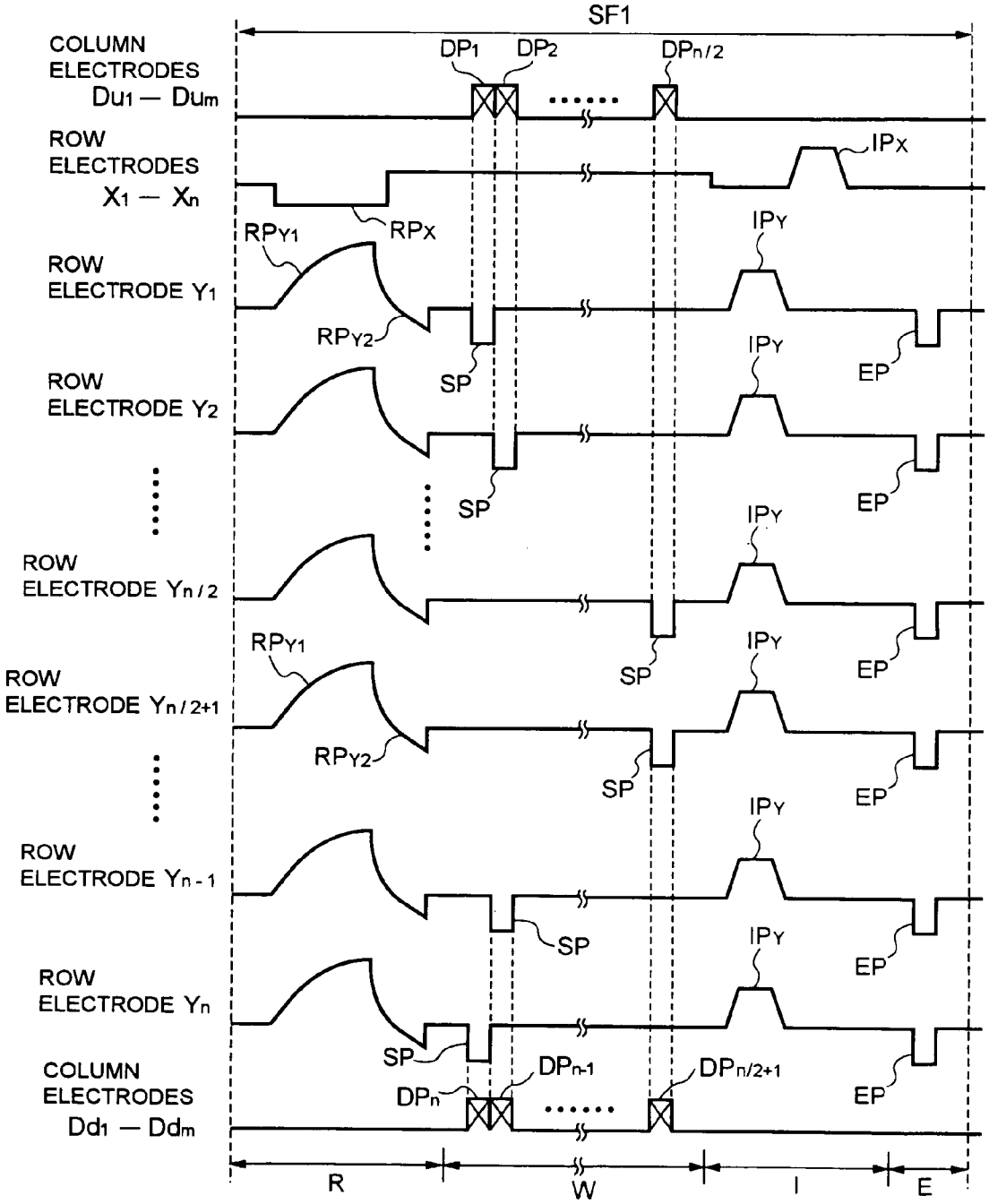
FIG. 3 is a diagram showing a variety of driving pulses applied to a PDP in accordance with the light emission driving sequence showing in FIG. 2, and timings at which the pulses are applied.
Figure 4:
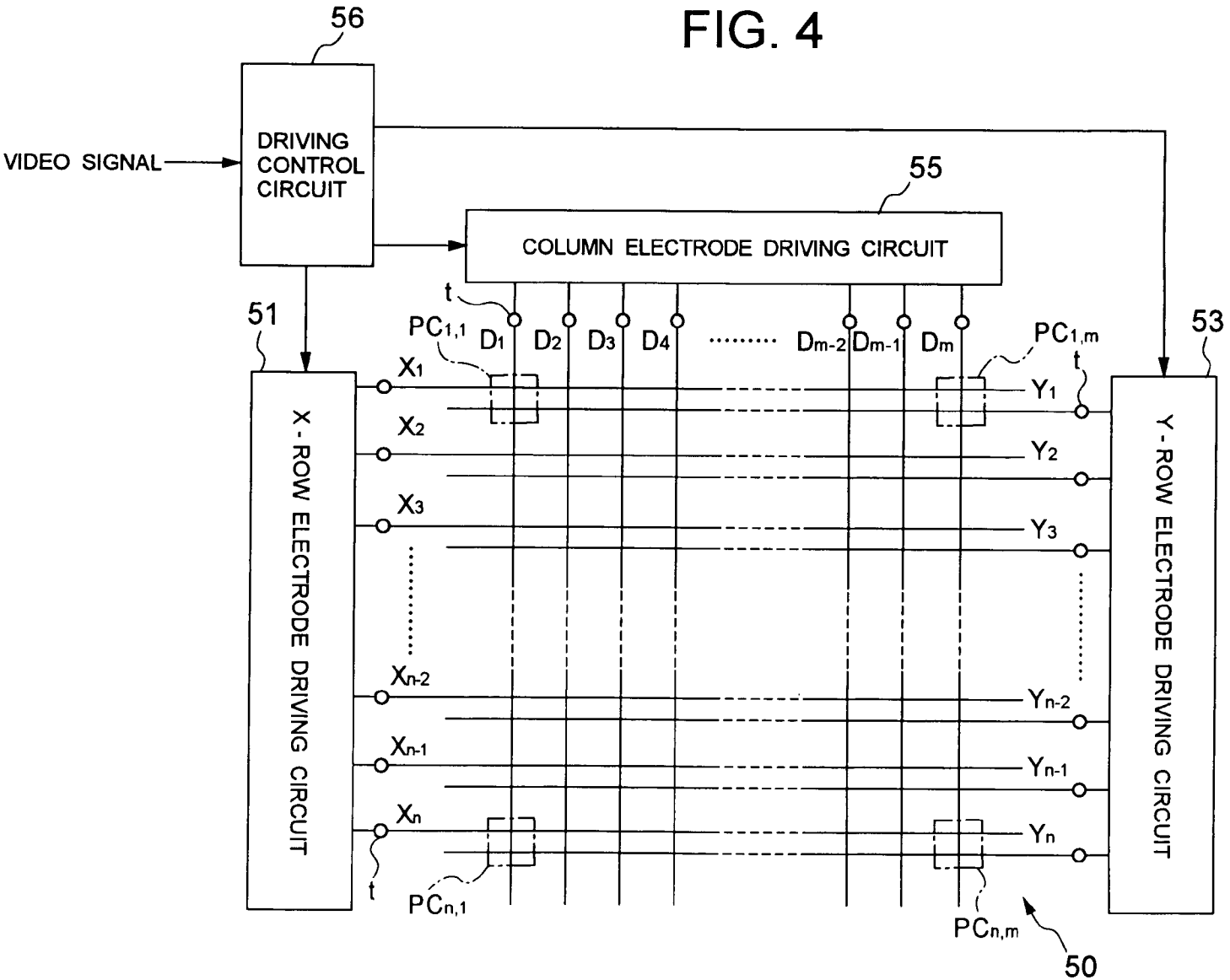
FIG. 4 is a diagram generally showing the configuration of a plasma display device according to the present invention.

FIG. 4 is a diagram generally showing the configuration of a plasma display device according to the present invention.

As shown in FIG. 4, the plasma display device comprises a PDP 50 as a plasma display panel, an X-row electrode driving circuit 51, a Y-row electrode driving circuit 53, a column electrode driving circuit 55, and a driving control circuit 56.

The PDP 50 is formed with column electrodes $D_1$-$D_m$ respectively extending in a vertical direction of a two-dimensional display screen, and row electrodes $X_1$-$X_n$ and row electrodes $Y_1$-$Y_n$ respectively extending in the horizontal direction of the two-dimensional display screen. In this event, row electrode pairs $(Y_1, X_1)$, $(Y_2, X_2)$, $(Y_3, X_3)$, . . . , $(Y_n, X_n)$, which form pairs with adjacent ones to each other, form a first display line to an n-th display line on the PDP 50. At the intersection of each display line with each of the column electrodes $D_1$-$D_m$ (an area surrounded by a one-dot chain line in FIG. 4), a display cell PC is formed to serve as a pixel. In other words, on the PDP 50, display cells $PC_{1,1}$-$PC_{1,m}$ belonging to the first display line, display cells $PC_{2,1}$-$PC_{2,m}$ belonging to the second display line, . . . , display cells $PC_{n,1}$-$PC_{n,m}$ belonging to the n-th display line are arranged in a matrix form.

Each of the column electrodes $D_1$-$D_m$, row electrodes $X_1$-$X_n$, and row electrodes $Y_1$-$Y_n$ is formed with a terminal t, such that each of the column electrodes $D_1$-$D_m$ is connected to the column electrode driving circuit 55 through the terminal t thereof; each of the row electrodes $X_1$-$X_n$ is connected to the X-row electrode driving circuit 51 through the terminal t thereof; and each of the row electrodes $Y_1$-$Y_n$ is connected to the Y-row electrode driving circuit 53 through the terminal t thereof.

Figure 5:
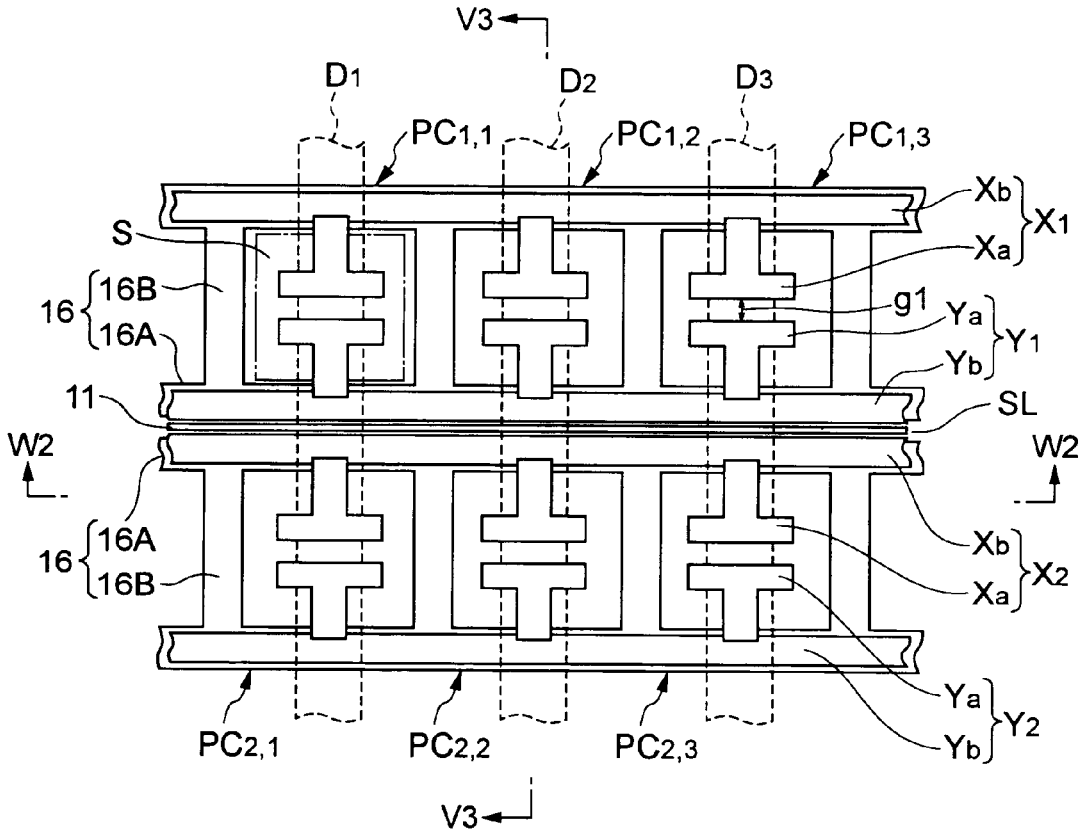
FIG. 5 is a front view schematically showing the internal structure of the PDP when viewed from a display screen side of the device in FIG. 4.
Figure 6:
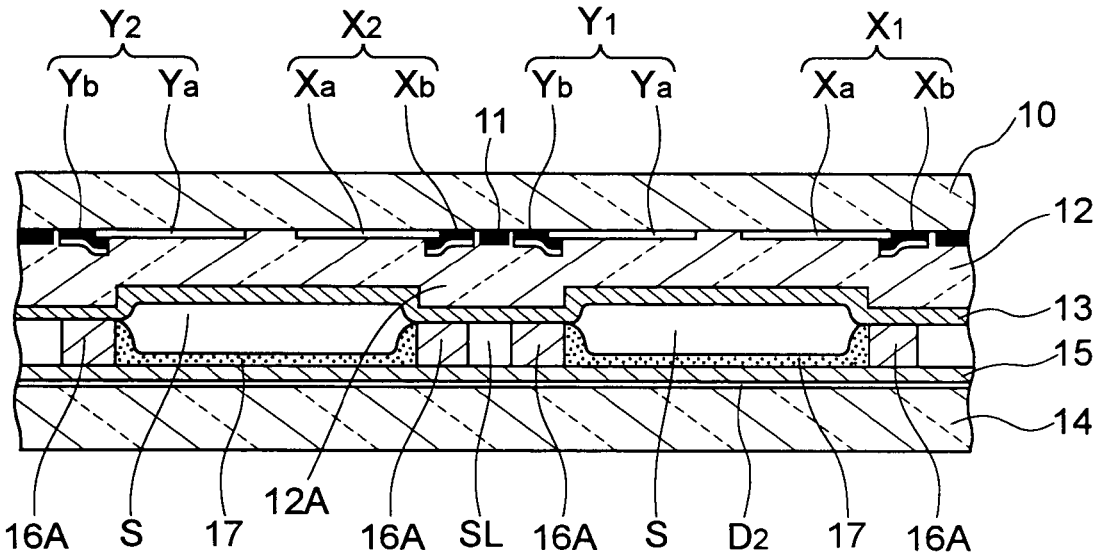
FIG. 6 is a diagram showing a cross-sectional view taken along a V3-V3 line shown in FIG. 5.
Figure 7:
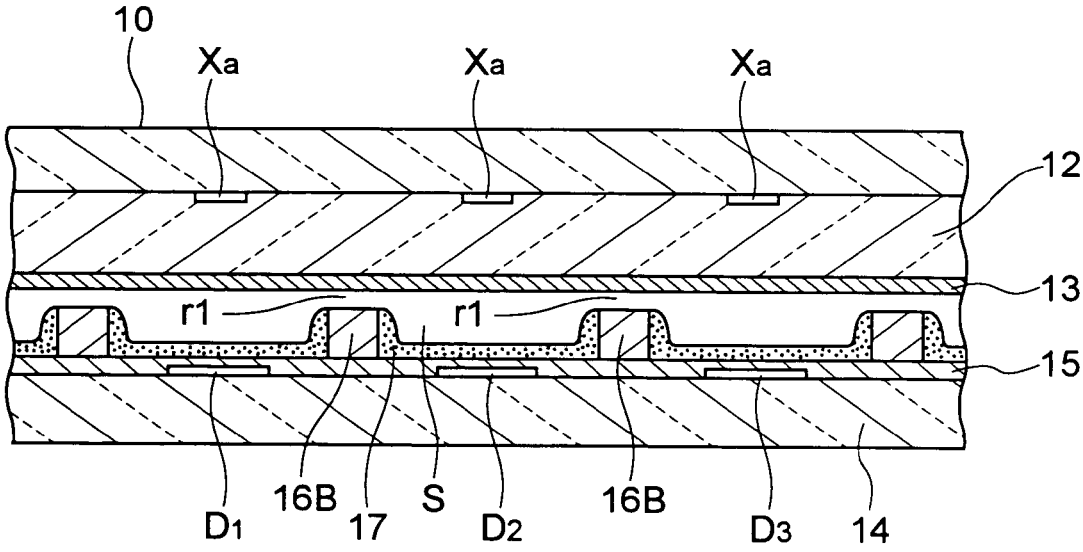
FIG. 7 is a diagram showing a cross sectional view taken along a W2-W2 line shown in FIG. 5.

FIG. 5 is a front view schematically showing the internal structure of the PDP 50 when viewed from the display surface side. In FIG. 5, intersections of each of the column electrodes $D_1$-$D_3$ to the first display line $(Y_1, X_1)$ and second display line $(Y_2, X_2)$ are extracted for illustration. FIG. 6 is a cross-sectional view of the PDP 50 taken along a V3-V3 line in FIG. 5, and FIG. 7 is a cross-sectional view of the PDP 50 taken along a line W2-W2 in FIG. 5.

As shown in FIG. 5, each row electrode X is comprised of a bus electrode Xb extending in the horizontal direction of the two-dimensional display screen, and a T-shaped transparent electrode Xa arranged in contact with a position corresponding to each display cell PC on the bus electrode Xb. Each row electrode Y is comprised of a bus electrode Yb extending in the horizontal direction of the tow-dimensional display screen, and a T-shaped transparent electrode Ya arranged in contact with a position corresponding to each display cell PC on the bus electrode Yb. The transparent electrodes Xa, Ya are made of an electrically conductive transparent film, for example, ITO or the like, while the bus electrodes Xa, Xb are made, for example, of a metal film. The row electrode X comprised of the transparent electrode Xa and bus electrode Xb, and the row electrode Y comprised of the transparent electrode Ya and bus electrode Yb are formed on the back side of a front transparent substrate, the front side of which is a display screen of the PDP 50, as shown in FIG. 6. In this structure, the transparent electrodes Xa, Ya in each row electrode pair (X, Y) extend toward the row electrode with which it forms a pair, and peak sides of their wider portions oppose each other through a discharge gap g1 of a predetermined width. Also, on the back side of the front transparent substrate 10, a black or a dark light absorbing layer (light shielding layer) 11 is formed to extend in the horizontal direction of the two-dimensional display screen between the pair of row electrode $(X_1, Y_1)$ and the row-electrode pair $(X_2, Y_2)$ adjacent to this row electrode pair. Further, on the back side of the front transparent substrate 10, a dielectric layer 12 is formed to cover the row electrode pairs (X, Y). On the back side of the dielectric layer 12 (surface opposite to the surface in contact with the row electrode pairs), a raised dielectric layer 12A is formed in a portion corresponding to a region which is formed with the light absorbing layer 11 and the bus electrodes Xb, Yb adjacent to this light absorbing layer 11, as shown in FIG. 6. Formed on the surfaces of the dielectric layer 12 and raised dielectric layer 12A is a magnesium oxide layer 13 which includes vapor-phase method magnesium oxide crystals (MgO) single crystal powder.

On the back substrate 14 arranged in parallel with the front transparent substrate 10, each of the column electrodes D is formed to extend in a direction perpendicular to the row electrode pair (X, Y) at a position opposite to the transparent electrodes Xa, Ya in each row electrode pair (X, Y). On the back substrate 14, a white column electrode protection layer 15 is further formed for covering the column electrodes D. Partitions 16 are formed on the column electrode protection layer 15. The partitions 16 are formed in a ladder shape with a horizontal wall 16A extending in the horizontal direction on the two-dimensional display screen at a position corresponding to each of the bus electrodes Xb, Yb of each row electrode pair (X, Y), and a vertical wall 16B extending in the vertical direction on the two-dimensional display screen at each intermediate position between the column electrodes D adjacent to each other. For each display line, the partitions 16 are formed in a ladder shape as shown in FIG. 5, and a clearance SL as shown in FIG. 5 exists between the partitions 16 adjacent to each other. Also, the ladder-shaped partitions 16 define the display cells PC each including an independent discharge space S, and transparent electrodes Xa, Ya. The discharge space S is filled with a discharge gas including a xenon gas. On a side surface of the horizontal wall 16A, a side surface of the vertical wall 16B, and the surface of the column electrode protection layer 15 in each display cell PC, a fluorescent material layer 17 is formed to cover these surfaces, as shown in FIG. 6. Actually, the fluorescent material layer 17 comprises three types of fluorescent materials for emitting red light, green light, and blue light. Between the discharge space S and the gap SL of each display cell PC, the horizontal wall 16A abuts to the magnesium oxide layer 13 to close each other, as shown in FIG. 6. On the other hand, as shown in FIG. 7, the magnesium oxide layer 13 does not abut to the vertical wall 16B, so that a gap r1 exists therebetween. In other words, the discharge spaces S of the display cells PC adjacent to each other in the horizontal direction on the two-dimensional display screen are in communication with one another through the gap r1.

Figure 9:
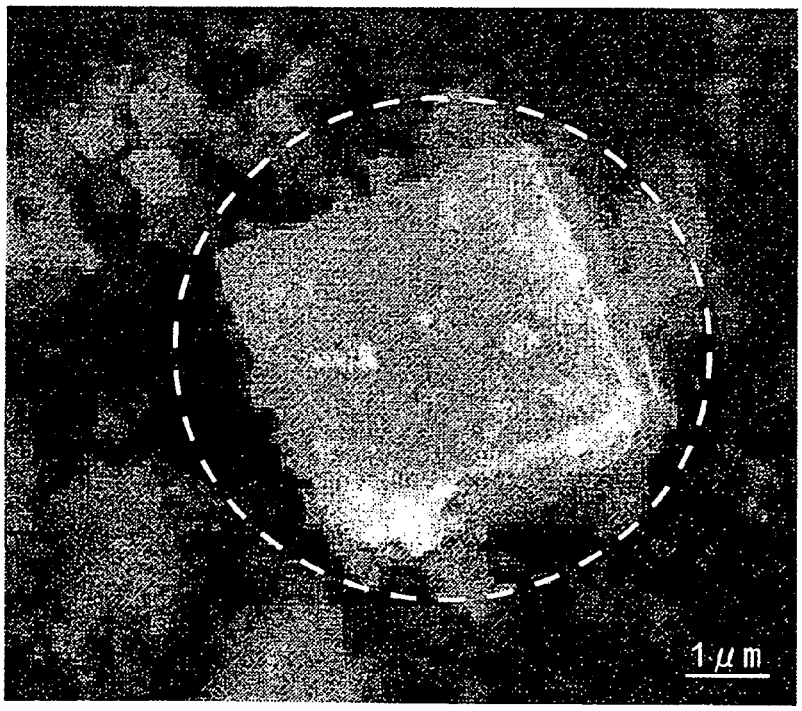
FIG. 9 is a diagram showing magnesium oxide single crystals having a cubic multiple crystal structure.
Figure 10:
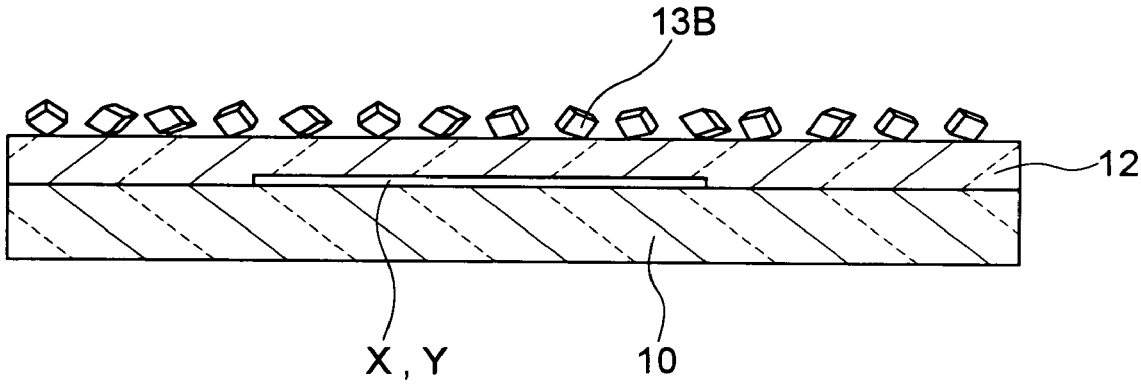
FIG. 10 is a diagram showing how a magnesium oxide single crystal powder is adhered to the surfaces of a dielectric layer and a raised dielectric layer to form a magnesium oxide layer.

Here, the magnesium oxide crystals, which form the magnesium oxide layer 13, include magnesium oxide crystals that are produced by heating magnesium to generate a magnesium vapor, and oxidizing the magnesium vapor in a vapor phase, for example, vapor-phase method magnesium crystals that are excited by an electron beam irradiated thereto to perform cathode luminescence light emission having a peak at a wavelength in a range of 200 to 300 nm (particularly, near 235 nm within 230-250 nm). The vapor-phase method magnesium oxide crystals include magnesium single crystals, the diameter of which is 2000 angstroms or more, have a multiple crystal structure in which solid crystals fit in each other, for example, as shown in a SEM photographed image in FIG. 8, or a solid single crystal structure as shown in a SEM photographed image in FIG. 9. The magnesium single crystals have the advantages of high purity, finer particulates, less aggregation of grains, and the like, as compared with magnesium oxide produced by another method, and contribute to improvements in the discharge characteristics such as a discharge delay, as will be later described. In this embodiment, the vapor-phase magnesium oxide single crystals used herein have an average grain diameter of 500 angstroms or more, and preferably 2000 angstroms or more, as measured by the BET method. Then, as shown in FIG. 10, the magnesium oxide single crystals are applied on the surface of the dielectric layer 12 by a spraying method, an electrostatic coating method or the like to form the magnesium oxide layer 13. Alternatively, a thin-film magnesium oxide layer may be formed on the surface of the dielectric layer 12 by vapor deposition or a sputtering method, and vapor-phase method magnesium oxide single crystals may be applied on the thin film magnesium oxide layer to form the magnesium oxide layer 13.

Figure 11:
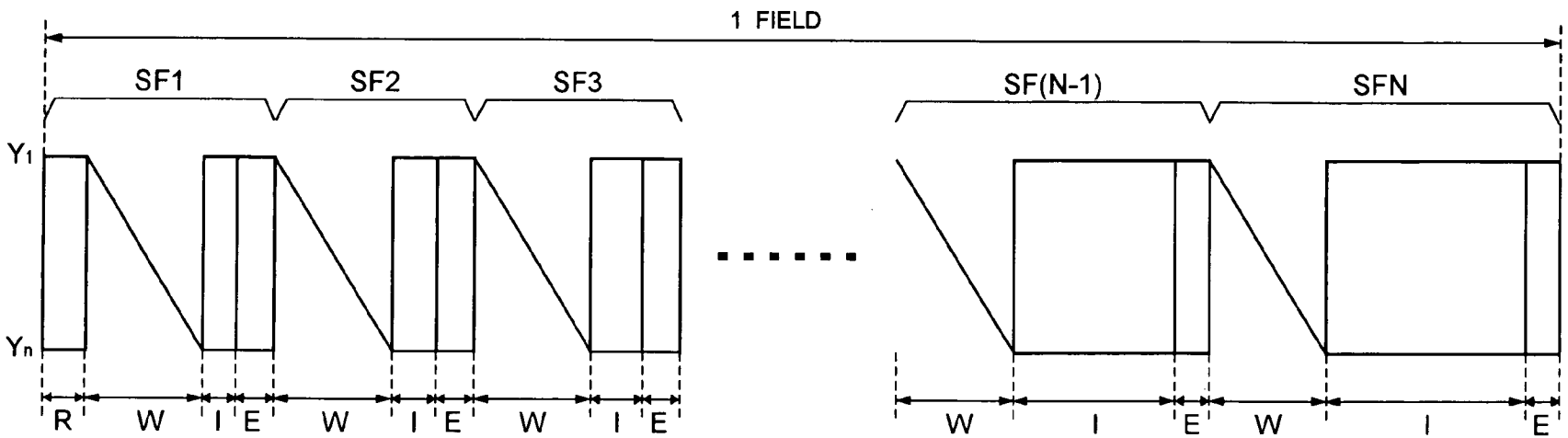
FIG. 11 is a diagram showing an exemplary light emission driving sequence employed in the plasma display device shown in FIG. 4.

The driving control circuit 56 supplies each of the X-row electrode driving circuit 51, Y-row electrode driving circuit 53, and column electrode driving circuit 55 with a variety of control signals for driving the PDP 50 having the foregoing structure in accordance with a light emission driving sequence which employs a sub-field method (sub-frame method) as shown in FIG. 11. The X-row electrode driving circuit 51, Y-row electrode driving circuit 53, and column electrode driving circuit 55 generate a variety of driving pulses (later described) for driving the PDP 50 in accordance with the light emission driving sequence shown in FIG. 11, and supply the generated pulses to the PDP 50.

In the light emission driving sequence shown in FIG. 11, an addressing stage W and a sustain stage I are executed in each of sub-fields SF1-SFN within a display period of one field. Also, a reset stage R is executed prior to the addressing stage only in the first sub-field SF1.

Figure 12:
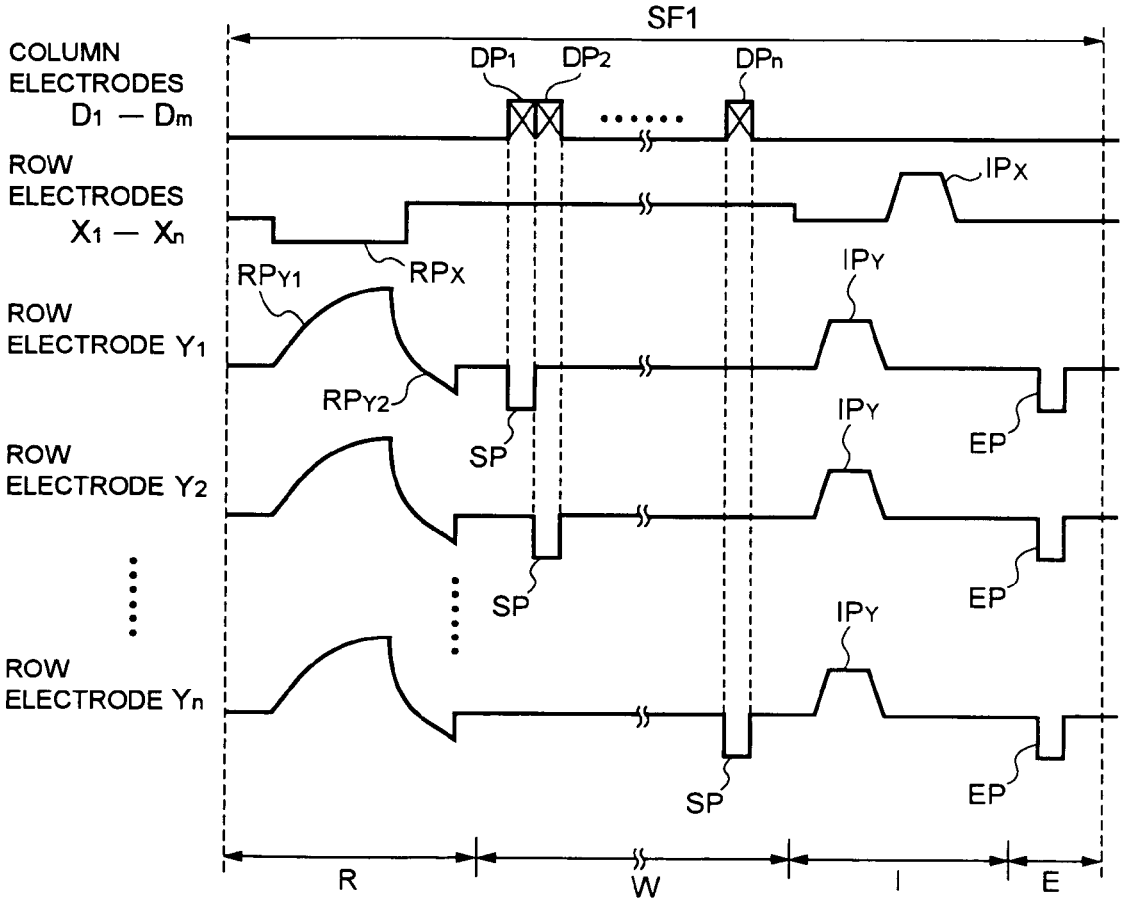
FIG. 12 is a diagram showing a variety of driving pulses applied to the PDP in accordance with the light emission driving sequence, and timings at which the pulses are applied.

FIG. 12 is a diagram showing timings at which a variety of driving pulses are applied to the column electrodes D and row electrodes X, Y of the PDP 50, in the sub-field SF1 which is extracted from the sub-fields SF1-SFN.

In the reset stage R which is performed prior to the addressing stage W only in the first sub-field SF1, the X-row electrode driving circuit 51 simultaneously applies the row electrodes $X_1$-$X_n$ with a reset pulse RPX of negative polarity, as shown in FIG. 12. Further, simultaneously with the application of the reset pulse $RP_X$, the Y-row electrode driving circuit 53 simultaneously applies the row electrodes $Y_1$-$Y_n$ with a first reset pulse $RP_{Y1}$ of positive polarity having a pulse waveform, the voltage of which slowly rises over time and reaches a peak voltage value, as shown in FIG. 12. The peak voltage value of the first reset pulse $RP_{Y1}$ is higher than the peak voltage values of the sustain pulses $IP_X$, $IP_Y$. With the simultaneous application of the reset pulse $RP_{Y1}$ and reset pulse $RP_X$ of negative polarity, a first reset discharge is produced between the row electrodes X, Y in each of all the display cells $PC_{1,1}$-$PC_{n,m}$. After the end of the first reset discharge, a predetermined amount of wall charge is formed on the surface of the magnesium oxide layer 13 in the discharge space S of each display cell PC. Specifically, a so-called wall charge is formed, where a positive charge is formed near the row electrode X on the surface of the magnesium oxide layer 13, while a negative charge is formed near the row electrode Y. Subsequently, the Y-row electrode driving circuit 53 generates a second reset pulse $RP_{Y2}$ of negative polarity which slowly changes in voltage at a rising edge, and simultaneously applies this pulse to all the row electrodes $Y_1$-$Y_n$. The peak voltage value of the second reset pulse $RP_{Y2}$ is set in a voltage range from a voltage value on the row electrode Y when it is not applied with the scanning pulse SP in the addressing stage W to the peak voltage value of the scanning pulse SP. In response to the application of the second reset pulse $RP_{Y2}$, a second reset discharge is produced between the row electrodes X, Y in each of all the display cells $PC_{1,1}$-$PC_{n,m}$. The second reset discharge extinguishes the wall charge formed in each of all the display cells $PC_{1,1}$-$PC_{n,m}$. In other words, with the reset stage R, all the display cells $PC_{1,1}$-$PC_{n,m}$ are initialized to the unlit cell state in which no wall charge exists. In the first and second reset discharges, a discharge is produced in each display cell PC, and since the magnesium oxide layer 13 is formed in the display cell, the priming effect provided by the reset discharge lasts for a longer time to permit faster addressing.

In the reset stage R, the row electrode Y is applied with the first reset pulse $RP_{Y1}$, which slowly changes in voltage at a rising edge, so that a faint first reset discharge is produced between the T-shaped transparent electrodes Ya, Xa, with the intention to improve the contrast.

Since the discharge probability is extremely high in a panel which is provided with the vapor-phase method magnesium oxide layer 13 as a protection layer, the faint first reset discharge is produced with stability. A combination with a protrusive electrode, particularly, a T-shaped electrode having a wider leading end localizes the first reset discharge near the discharge gap to further limit the possibility of a strong and sporadic first reset discharge across the overall row electrode. Therefore, a strong discharge hardly occurs between the column electrode and the row electrode, thereby making it possible to produce a stable faint first reset discharge for a short duration.

Next, in the addressing stage W of each sub-field, the column electrode driving circuit 55 generates a pixel data pulse for setting whether or not each display cell PC is driven to emit light in this sub-field based on an input video signal. For example, the column electrode driving circuit 55 generates the pixel data pulse which is at a high voltage when a display cell PC is driven to emit light and at a low voltage which it is not driven to emit light for each display cell PC. Then, the column electrode driving circuit 55 applies the pixel data pulses for each display line (m pulses) to the column electrodes $D_1$-$D_m$ in sequence as pixel data pulses $DP_1$, $DP_2$, . . . , $DP_n$. In the meantime, the Y-row electrode driving circuit 53 sequentially applies the row-electrodes $Y_1$-$Y_n$ with a scanning pulse SP of negative polarity in synchronism with the timing of each of the pixel data pulse groups $DP_1$-$DP_n$. In this event, a discharge (selective discharge) is produced only in a display cell PC which is applied with the scanning pulse SP and with the pixel data pulse at high voltage, resulting in the formation of a predetermined amount of wall charge on the surfaces of the magnesium oxide layer 13 and fluorescent material layer 17 in the discharge space S of the display cell PC. In a display cell PC which is applied with the scanning pulse SP but with the pixel data pulse at low voltage, the selective discharge as mentioned above is not produced, thus maintaining the formation of the wall charge immediately before the application of the pulses.

In other words, through the execution of the addressing stage W, each display cell PC is set to one of a lit cell state in which a predetermined amount of wall charge exists, and an unlit cell state in which a predetermined amount of wall charge does not exist, based on an input video signal.

Next, in the sustain stage I of each sub-field, each of the X-row electrode driving circuit 51 and Y-row electrode driving circuit 53 alternately and repeatedly apply sustain pulses $IP_X$, $IP_Y$ of positive polarity to the row electrodes $X_1$-$X_n$, $Y_1$-$Y_n$, respectively. The number of times the sustain pulses $IP_X$, $IP_Y$ are applied depends on weighting of luminance in each sub-field. In this event, each time these sustain pulses $IP_X$, $IP_Y$ are applied, a sustain discharge is produced only in display cells in the lit cell state, each of which is formed with a predetermined amount of wall charge, and the fluorescent layer 17 emits light, associated with the discharge, to form an image on the panel surface.

Figure 8:
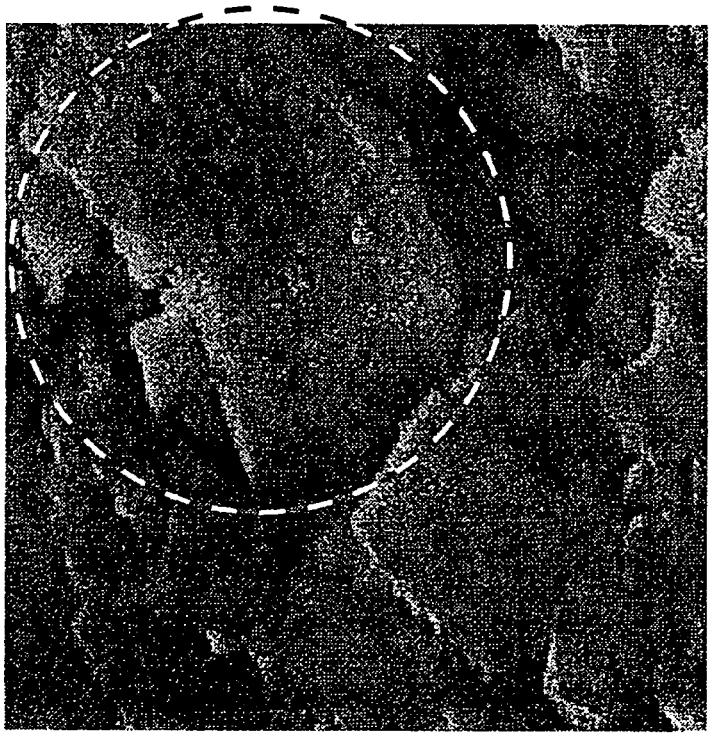
FIG. 8 is a diagram showing magnesium oxide single crystals having a cubic multiple crystal structure.
Figure 13:
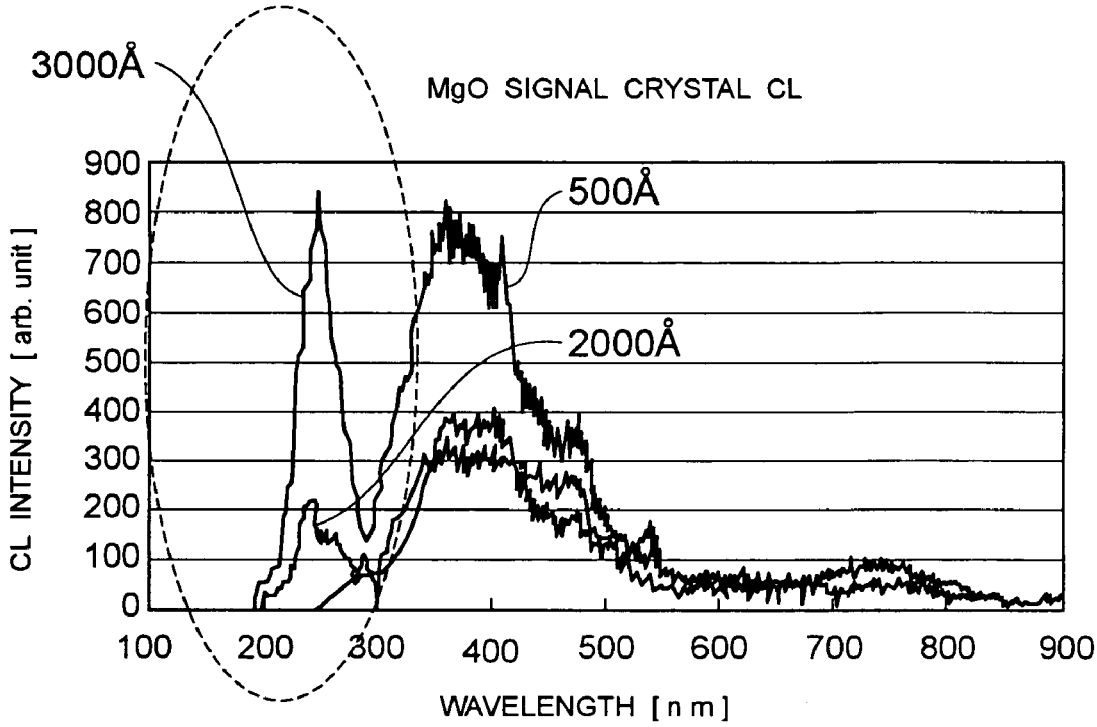
FIG. 13 is a graph showing the relationship between the grain diameter of magnesium oxide single crystal powder and the wavelength of CL light emission.
Figure 14:
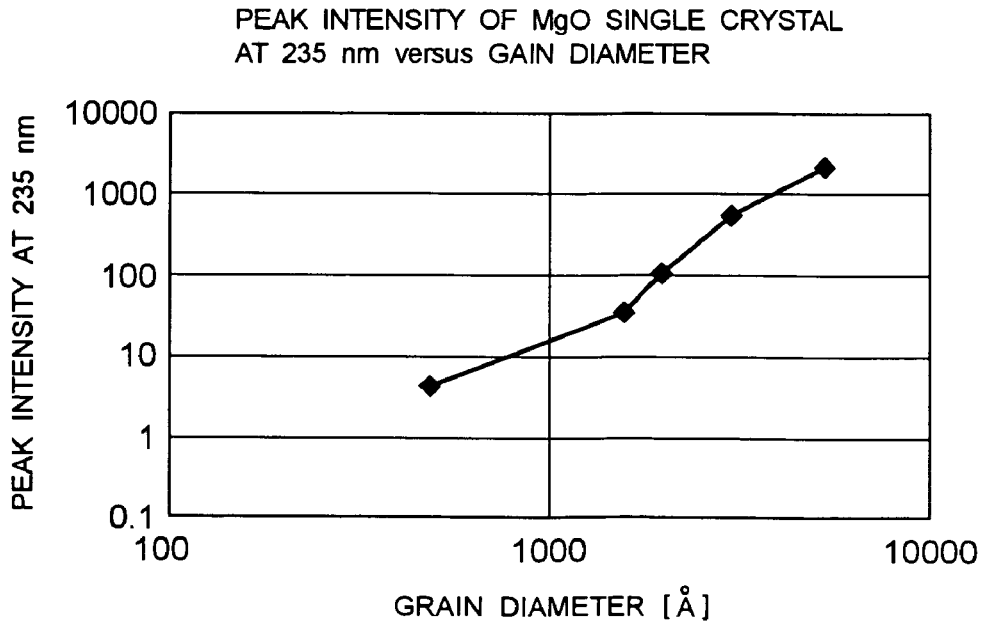
FIG. 14 is a graph showing the relationship between the grain diameter of magnesium oxide single crystal powder and the intensity of CL light emission of 235 nm.

As described above, the vapor-phase magnesium oxide single crystals included in the magnesium oxide layer 13 formed in each display cell PC are excited by an electron beam irradiated thereto to emit CL light having a peak in a wavelength range of 200-300 nm (particularly, near 235 nm in 230-250 nm), as shown in FIG. 13. In this event, as shown in FIG. 14, the emitted CL light having a peak at 235 nm exhibits a higher peak intensity as the vapor-phase based magnesium oxide single crystals have larger grain diameters. Specifically, when vapor-phase magnesium oxide crystals are produced, as magnesium is heated at temperatures higher than usual, single crystals having a relatively large grain diameters of 2000 angstroms or more, as shown in FIG. 8 or 9, are formed together with vapor-phase magnesium oxide single crystals having an average grain diameter of 500 angstroms. In this event, since the magnesium is heated at temperatures higher than usual, a flame associated with the reaction of magnesium with oxygen also becomes longer. Consequently, a larger temperature difference is produced between the flame and ambient, so that it is estimated that a group of magnesium oxide single crystals having larger diameters include more single crystals which exhibit high energy levels corresponding to 200-300 nm (particularly, 235 nm).

Figure 15:
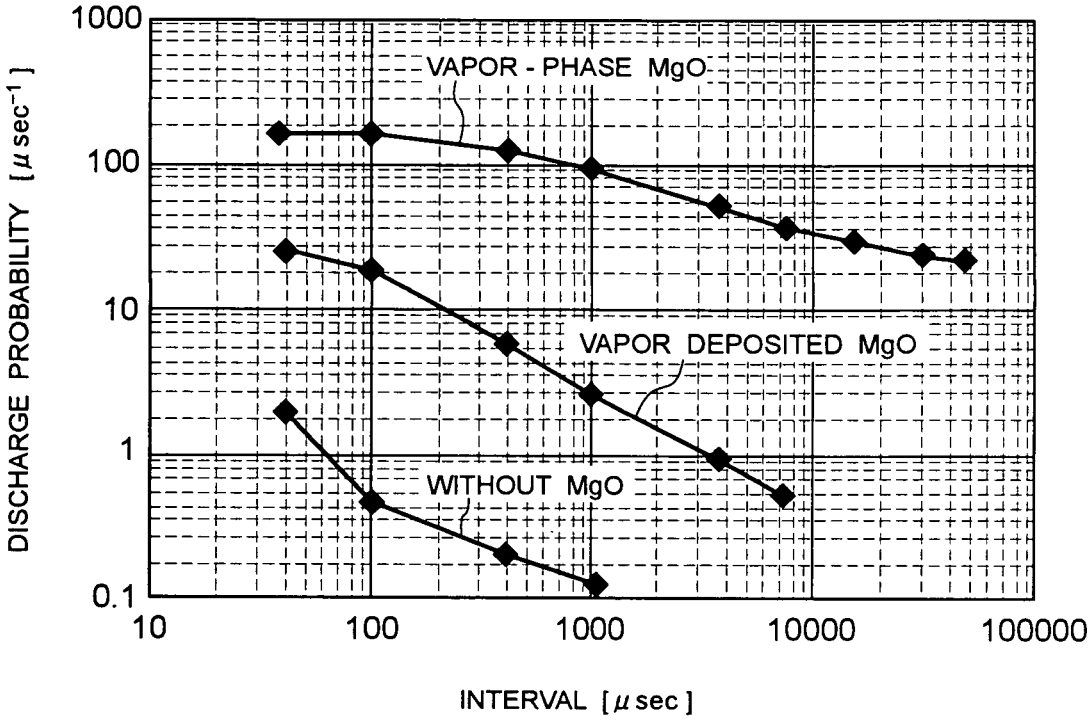
FIG. 15 is a diagram showing a discharge probability when no magnesium oxide layer is formed in a display cell PC, a discharge probability when a magnesium oxide layer is formed in accordance with a conventional vapor deposition method, and a discharge probability when a magnesium oxide layer is formed in a multiple crystal structure.

FIG. 15 is a diagram showing a discharge probability when a display cell PC is not formed therein with a magnesium oxide layer, a discharge probability when a display cell PC is formed therein with a magnesium oxide layer according to a conventional vapor deposition method, and a discharge probability when a display cell PC is formed with a magnesium oxide layer including magnesium oxide single crystals which involve the emission of CL light having a peak in a range of 200-300 nm (particularly, near 235 nm within 230-250 nm) with the irradiation of an electron beam. In FIG. 15, the horizontal axis represents a discharge interval, i.e., a time interval from the time a discharge is produced to the time the next discharge is produced.

Figure 16:
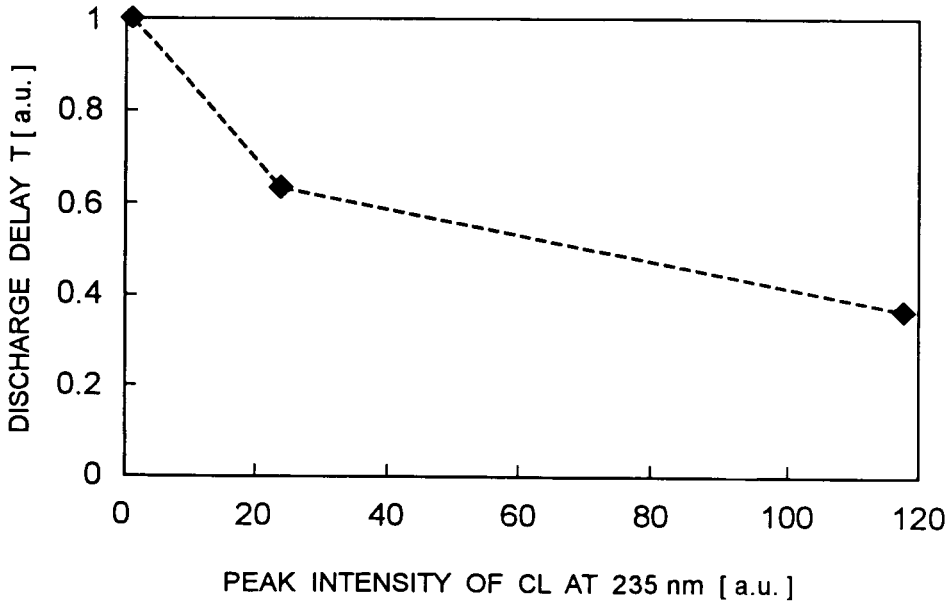
FIG. 16 is a diagram showing a correspondence relationship between the intensity of CL light emission, the peak of which is at 235 nm, and a discharge delay time.
Figure 17:
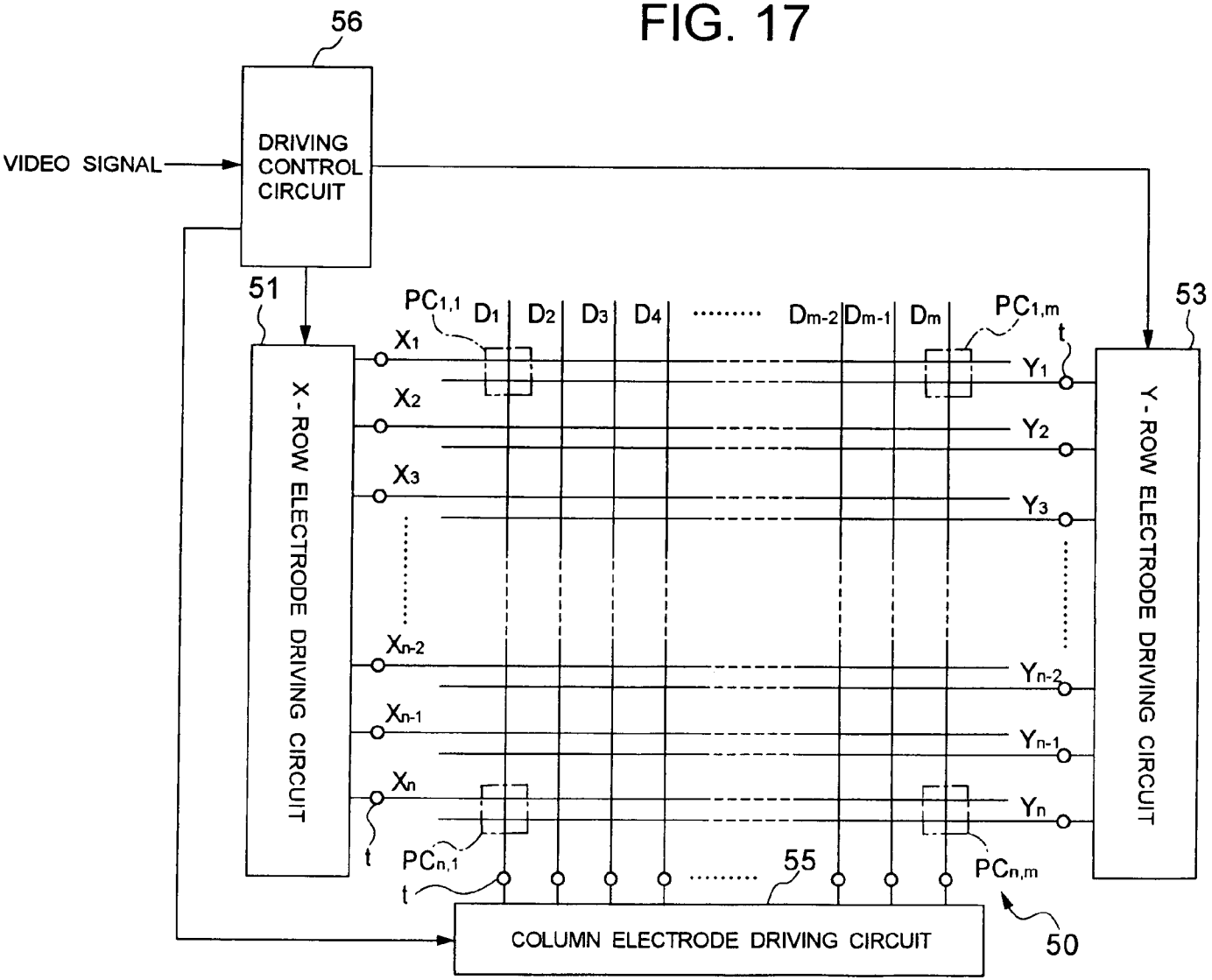
FIG. 17 is a diagram generally showing the configuration of a plasma display device according to another embodiment of the present invention.

As shown, when each display cell PC contains, in the discharge space S, the magnesium oxide layer 13 including magnesium oxide single crystals which involve the emission of CL light having a peak in a range of 200-300 nm (particularly, near 235 nm within 230-250 nm) with the irradiation of an electron beam, the discharge probability is increased as compared with the display cell PC having the magnesium oxide layer formed by a conventional vapor deposition method. As shown in FIG. 16, the vapor-phase magnesium oxide single crystals can reduce a delay in a discharge produced in the discharge space S as it has a higher intensity of the CL light emission, particularly, the CL light emission having a peak at 235 nm when they are irradiated with an electron beam.

Thus, even if the first reset pulse $RP_{Y1}$ applied to the row electrode Y is generated such that its voltage slowly changes as shown in FIG. 11 to produce a faint first reset discharge with the intention to limit the light emission associated with the reset discharge not involved in displaying an image to improve the contrast, the faint first reset discharge can be produced with stability for a short duration. Particularly, since each display cell PC employs the structure which causes a discharge to be locally produced near the discharge gap between the T-shaped transparent electrodes Xa, Ya, this structure contributes to the prevention of a sporadic first reset discharge so strong as to produce a discharge across the overall row electrode, and also to the prevention of a strong erroneous discharge between the column electrode and the row electrode.

Also, since a higher discharge probability (shorter discharge delay) permits the priming effect by the reset discharge in the reset stage R to last for a longer time, the address discharge produced in the addressing stage W and the sustain discharge produced in the sustain stage I become faster. This can reduce the pulse width of each of the pixel pulse DP and the scanning pulse SP, as shown in FIG. 12, which are applied to the column electrode D and row electrode Y, respectively, to produce the address discharge, thus permitting a corresponding reduction in the processing time spent for the addressing stage W. Further, the faster address discharge and sustain discharge can reduce the pulse width of the sustain pulse $IP_Y$, as shown in FIG. 12, which is applied to the row electrode to produce the sustain discharge, thus permitting a corresponding reduction in the processing time spent for the sustain stage I.

Consequently, an increased number of sub-fields can be provided in the one-field (or one-frame) display period by the reduction in the processing time spent for each of the addressing stage W and sustain stage I, thereby increasing the number of gradation levels.

While the PDP 50 in the foregoing embodiment employs the structure which has the display cell PC formed between the row electrode X and the row electrode Y which form a pair, such as row electrode pairs ($X_1$, $Y_1$), ($X_2$, $Y_2$), ($X_3$, $Y_3$), . . . , ($X_n$, $Y_n$), the PDP 50 may employ a structure which has display cells PC formed between all row electrodes adjacent to each other. Specifically, in this possible structure, the display cells PC may be formed between the row electrodes $X_1$, $Y_1$, between the row electrodes $Y_1$, $X_2$; between the row electrodes $X_2$, $Y_2$, . . . , between the row electrodes $Y_{n-1}$, $X_n$, and between the row electrodes $X_n$, $Y_n$, respectively.

Further, while the PDP 50 in the foregoing embodiment employs the structure which has the row electrodes X, Y formed on the front transparent substrate 10, and the column electrodes D and fluorescent layer 17 formed on the back substrate 14, respectively, the PDP 50 may employ a structure which has the column electrodes D as well as the row electrodes X, Y formed on the front transparent substrate 10, and the fluorescent layer 17 formed on the back substrate 14.

In the erasure stage E of each sub-field, the Y-row electrode driving circuit 53 applies the row electrodes $Y_1$-$Y_n$ with an erasure pulse EP of negative polarity as shown in FIG. 12. In response to the application of the erasure pulse EP, an erasure discharge is produced in display cells in which the sustain discharge was produced in the preceding sustain stage I. This erasure discharge extinguishes the wall charges formed in the display cells, causing the cells to transition to the unlit cell state.

The foregoing embodiment has been described in connection with a so-called selective write address method which is employed for driving the PDP 50 to display halftone images, by initializing the display cells such that wall charges remaining in all the display cells are reduced to less than a predetermined value (reset stage R), and selectively forming a wall charge equal to or more than a predetermined value in each display cell based on an input video signal (addressing stage W). However, a so-called selective erasure address method may be employed instead for driving the PDP 50 to display halftone images, by forming a wall charge equal to ore more than a predetermined value in each of all the display cells (reset stage R), and selectively reducing the wall charge formed in each display cell to less than a predetermined value in accordance with pixel data (addressing stage W). With the employment of the selective erasure address method, the first reset discharge can also be generated at a low discharge strength with stability in the reset stage R, as is the case with the employment of the selective write address method.

Also, the foregoing embodiment has shown an example in which the row electrode is also applied with reset pulse $RP_X$ simultaneously with the first reset pulse $RP_{Y1}$ applied to the row electrode Y. However, the reset pulse $RP_X$ may be omitted with the row electrode X being set at the ground potential. Further, the row electrode Y may be applied with the first reset pulse $RP_{Y1}$ which has a first section in which the first reset pulse $RP_{Y1}$ is suddenly increased to a first predetermined voltage value lower than a discharge start voltage, and a subsequent section in which the voltage value of the first reset pulse $RP_{Y1}$ slowly changes over time to reach a peak voltage value. In essence, the first reset pulse $RP_{Y1}$ employed herein is only required to slowly change the voltage in a section in which the reset discharge is produced.

Further, in the foregoing embodiment, the column electrode draw-out terminal t at the upper end of the panel 50 (back substrate), but for countermeasures against heat dissipation, the column electrode draw-out terminal t may be disposed at a lower end of the panel 50 (back substrate), such that each of the column electrodes $D_1$-$D_m$ is connected to the column electrode driving circuit 55 through the terminal t. In the latter case, since the column electrode driving circuit 55 is located at the lower end of the panel 50, an address driver IC, which forms part of the column electrode driving circuit, is prevented from being heated by heat from the panel, which is advantageous in terms of countermeasures against heat dissipation.

As described above, according to the present invention, each display cell of a plasma display panel used herein has a magnesium oxide layer which includes magnesium oxide crystals that is excited by an electron beam to emit cathode luminescence light that has a peak in a wavelength range from 200 to 300 nm, the scanning pulse is in turn applied to one row electrodes in row electrode pairs which constitute all display lines in an addressing period, and the column electrode driving circuit supplies the column electrodes with data pulses corresponding to a display line which is applied with the scanning pulse. Thus, the address scanning can be speeded up without damaging the stability of the address scanning.

This application is based on Japanese Patent Applications No. 2004-154397, No. 2004-204156, and No. 2004-289791 which are hereby incorporated by reference.

What is claimed is:

1. A plasma display device comprising:

a plasma display panel including a plurality of row electrode pairs which constitute display lines, a plurality of column electrodes intersecting with said plurality of row electrode pairs, and display cells each formed at each of the intersections of said row electrode pairs with said column electrodes, each of said display cells having a magnesium oxide layer including magnesium oxide crystals which are excited by an electron beam to emit cathode luminescence light having a peak in a wavelength range from 200 to 300 nm;

a row electrode driving circuit for driving each of said plurality of row electrode pairs; and a column electrode driving circuit for driving each of said plurality of column electrodes, so that a halftone image is displayed in a one-field display period which is divided into a plurality of sub-fields each of which includes an addressing period and a sustain period, wherein in said addressing period, said row electrode driving circuit applies a scanning pulse to one row electrodes of said row electrode pairs in turn, while said column electrode driving circuit supplies said column electrodes with data pulses corresponding to a display line which are applied with the scanning pulse.

2. A plasma display device according to claim 1, wherein each row electrode of said row electrode pair includes a body extending in a row direction, and a protrusion protruding from said body in a column direction so as to oppose each other through a discharge gap.

3. A plasma display device according to claim 2, wherein said protrusion of said row electrode includes a wider portion near said discharge gap, and a narrower portion for connecting said wider portion to said body.

4. A plasma display device according to claim 1, wherein said magnesium oxide layer includes magnesium single crystals which are produced by heating magnesium to generate magnesium vapor, and oxidizing the magnesium vapor in a vapor phase.

5. A plasma display device according to claim 4, wherein said magnesium oxide layer includes magnesium oxide single crystals, the diameter of which is 2,000 angstroms or more.

6. A plasma display device according to claim 1, wherein said magnesium oxide single crystals emit cathode luminescence light having a peak in a wavelength range from 230 to 250 nm.

7. A plasma display device according to claim 1, wherein said magnesium oxide layer is formed on a dielectric layer which covers said row electrode pairs.

8. A plasma display device according to claim 1, wherein said panel is formed with a draw-out electrode terminal associated with each of the column electrodes only at one end in the column direction, and said column electrode driving circuit supplies the data pulses to said column electrodes through said terminals.

9. A plasma display device according to claim 8, wherein said terminals are formed at a lower end of said panel.

10. A method for driving a plasma display panel which includes a plurality of row electrode pairs which constitute display lines, a plurality of column electrodes intersecting with said plurality of row electrodes, and display cells each formed at each of the intersections of said row electrode pairs with said column electrodes, each of said display cells having a magnesium oxide layer including magnesium oxide crystals which are excited by an electron beam to emit cathode luminescence light having a peak in a wavelength range from 200 to 300 nm, to display a halftone image in a one-field display period which is divided into a plurality of sub-fields each of which includes an addressing period and a sustain period, said method comprising the step of:

in said addressing period, applying a scanning pulse to one row electrodes of said row electrode pairs in turn, and supplying said column electrodes with data pulses cor responding to display lines which are applied with the scanning pulse.

11. A method for driving a plasma display device according to claim 10, wherein said magnesium oxide layer includes magnesium single crystals which are produced by heating magnesium to generate magnesium vapor, and oxidizing the magnesium vapor in a vapor phase.

12. A method for driving a plasma display device according to claim 10, wherein said magnesium oxide layer includes magnesium oxide single crystals, the diameter of which is 2,000 angstroms or more.

* * * * *